US005421711A

United States Patent [19]

Newton

[11] Patent Number: 5,421,711

[45] Date of Patent: Jun. 6, 1995

[54] DOWNHOLE PUMP DRIVE SYSTEM

[76] Inventor: Timothy M. Newton, HCR3, Box 86C, Del Rio, Tex. 78840

[21] Appl. No.: 161,330

[22] Filed: Dec. 2, 1993

[51] Int. Cl.[6] ..... F04B 17/00

[52] U.S. Cl. ..... 417/401

[58] Field of Search ..... 417/398, 399, 400, 401, 417/403

[56] References Cited

U.S. PATENT DOCUMENTS

| | | | |
|---|---|---|---|
| 1,616,773 | 2/1927 | Warren | 417/388 |
| 1,765,921 | 6/1930 | Joy | 417/401 |
| 1,981,288 | 11/1934 | Ross | 417/401 |
| 2,261,752 | 11/1941 | Buckner | 417/398 |
| 2,342,855 | 2/1944 | Green | 417/401 |
| 2,942,552 | 6/1960 | Wayt | 417/390 |
| 3,159,105 | 12/1964 | Chenault | 417/390 |
| 3,374,746 | 3/1968 | Chenault | 417/403 |

*Primary Examiner*—Timothy S. Thorpe
*Attorney, Agent, or Firm*—Donald R. Comuzzi; Christopher L. Makay

[57] ABSTRACT

A downhole pump comprises a pump cylinder driven by a pneumatic cylinder. A compressor compresses air and delivers compressed air to the pneumatic cylinder under the control of first and second trip valves and a pilot valve. The trip valves control the pilot valve so that it alternately delivers the compressed air above and below the pneumatic cylinder piston to reciprocally drive the piston. The pneumatic cylinder piston connects to the pump cylinder via a pair of push rods to drive the pump cylinder piston to pump water from the well to an above-ground reservoir.

7 Claims, 1 Drawing Sheet

DOWNHOLE PUMP DRIVE SYSTEM

BACKGROUND OF THE INVENTION

1. Field of the Invention

The present invention relates to pneumatic drive systems for pumps and, more particularly, but not by way of limitation, to a pneumatically driven pump system positionable within a borehole to pump fluids from a well.

2. Description of the Related Art

In the absence of electrical power, windmills remain the preferred device for pumping fluids, especially water, from the ground. Windmills typically comprise a vaned wheel connected to a shaft which is supported on a frame. As the vaned wheel rotates, gears transfer the rotational force developed by the shaft to sucker rods which connect to a downhole pump. The sucker rods drive the downhole pump to pump water from the well. Windmill driven pumping systems operate adequately provided there is a sufficient amount of wind to drive the windmill's vaned wheel. However, during periods of low wind activity, the vaned wheel supplies no power to the pump, resulting in periods of water shortages.

In an attempt to provide pumping power regardless of wind activity, U.S. Pat. No. 4,358,250, issued Nov. 9, 1982 to Payne, discloses storing energy developed by the windmill during high levels of wind activity for use during low levels of wind activity. In Payne, the drive shaft of the vaned wheel connects to a compressor which compresses air and stores the compressed air for later use. The compressor delivers the compressed air to a pneumatic cylinder positioned over the borehole of the well to reciprocally drive the pneumatic cylinder. Sucker rods connect the pneumatic cylinder to a downhole pump so that the reciprocating motion of the pneumatic cylinder drives the pump to pump water from the well. Thus, the windmill disclosed in Payne operates on a continual and constant basis because it stores energy in the form of compressed air for later use.

Unfortunately, although the Payne windmill stores energy for later use, it suffers the same disadvantages as all windmills employing an above-ground pump drive system. Specifically, when the pump drive system resides above the ground, sucker rods must be utilized to deliver the driving force of the drive system to the pump. Sucker rods typically consist of wooden rods in twenty foot sections coupled together with metal connectors. Sucker rods are impractical because they are expensive and must be replaced often. The sucker rods must be replaced often because they are wooden and, as such, rapidly deteriorate in the water. Additionally, when the sucker rods are removed to permit work on the well, they must be continually wet with water to prevent their drying out. If they dry out before their return to the well, they fall apart within the well which results in their again having to be replaced.

Furthermore, if the sucker rods become misaligned within the borehole, the metal connectors coupling them together rub against the borehole casing as the sucker rods reciprocate. The rubbing of the metal connectors against the borehole casing results in holes wearing through the casing which causes leaking. Once the casing begins to leak, it must be replaced. Unfortunately, both the borehole casing and the labor involved in replacing it are extremely expensive. Accordingly, pump drive systems positioned above-ground are high cost systems requiring significant amounts of maintenance.

U.S. Pat. No. 4,385,871, issued on May 31, 1983 to Beisel, attempts to overcome the above problems by utilizing a windmill which eliminates sucker rods. In Beisel, a windmill drives an air compressor which delivers compressed air directly into the well. The compressed air entering the well displaces the water and forces it from the well into the borehole and out an exit port from the bore hole. Although Beisel eliminates sucker rods, it is extremely inefficient and may only be employed in very shallow wells, typically 20 to 25 feet. That is, its windmill and compressor unit produce insufficient pressures within the well to drive water against the force of gravity for a distances of longer than the 20–25 feet. Thus, the Beisel device is impractical because most wells must exceed 20–25 feet in order to produce sufficient quantities of water.

U.S. Pat. No. 4,174,926, issued on Nov. 20, 1979 to Hamrick, et al., discloses a windmill that eliminates the necessity of sucker rods and, further, places the pump drive system within the well. The Hamrick, et al. system includes a propeller driven shaft which pressurizes hydraulic fluid stored within a fluid accumulator. The accumulator delivers the fluid to a turbine located downhole to drive the turbine which, in turn, drives a pump to pump water from the well.

Although the Hamrick, et al. system eliminates sucker rods, it suffers from a serious disadvantage. Specifically, the Hamrick, et al. system presents the serious problem of well contamination. If the hydraulic fluid utilized to drive the turbine leaks into the well water, it would contaminate the well, thereby making the water undrinkable. With the well contaminated with hydraulic fluid, it would have to be cleaned or possibly abandoned. In either instance, the cost to the well owner is significant. Accordingly, the Hamrick, et al. system fails to provide an adequate solution to above-ground pump drive systems because its use presents a potential health hazard.

Accordingly, a system that provides a pump drive system positioned downhole which does not utilize hydraulic fluid is highly desirable.

SUMMARY OF THE INVENTION

In accordance with the present invention, a pneumatic pump drive system resides downhole to eliminate the necessity of sucker rods and, further, provides a pump drive system capable of driving a well pump to pump fluid, especially water, from any depth well. A windmill or any other suitable power source drives a compressor which compresses air to operate a pneumatic cylinder positioned downhole. An advantage of using a windmill and compressor in tandem is that the windmill allows the compressor to operate in the absence of public power lines, while the compressor stores energy developed during peak operation of the windmill so that continuous operation of the pump may be effected.

The pneumatic cylinder connects to a pump cylinder to drive the pump cylinder to pump water from the well. The pneumatic cylinder and pump cylinder are configured to fit within a borehole and may be lowered to the bottom of a well. First and second hoses connect the pneumatic cylinder to the compressor via first and second trip valves and a pilot valve. The valves control the delivery of compressed air into the pneumatic cylinder to reciprocally operate the piston of the pneumatic cylinder. As the piston of the pneumatic cylinder reciprocates, it reciprocally drives the piston of the pump cylinder through its connection to the pump cylinder piston. As the pump cylinder piston reciprocates, the pump draws water from the well into its pump chamber where the pump cylinder piston forces the water from the pump chamber out through a one-way valve and up the borehole. Accordingly, as the pneumatic cylinder and, thus, the pump cylinder continue to operate, the pump cylinder piston forces water from the well to a reservoir at the surface.

Another advantage of using a windmill and compressor in tandem is that the windmill and compressor may be located remote from the well. Illustratively, the windmill typically should be placed at the highest point around the well to be most effective. However, if the well is drilled near the windmill, the borehole traverses additional earth because the hill must also be drilled through. However, because the pneumatic cylinder and pump cylinder reside downhole, the compressor is not required to be next to the borehole. Thus, the well may be drilled at a low point around the hill and the compressed air delivered downhole via the first and second hoses. Additionally, the pump cylinder is capable of pumping up hill so that water from the well may be pumped to a reservoir residing near the windmill on top of the hill. That allows a gravity feed system to be employed to deliver the water from the reservoir to areas requiring water.

It is, therefore, an object of the present invention to provide a well pump which includes a downhole drive system to eliminate the necessity of sucker rods.

It is another object of the present invention to provide a well pump which employs a downhole drive system not requiring hydraulic fluid.

It is a further object of the present invention to provide a well pump with a pneumatically operated cylinder as the downhole drive system.

It is still another object of the present invention to provide a well pump with a downhole drive system which operates remote from a windmill and compressor power source.

It is still a further object of the present invention to provide a well pump with valves to control the delivery of compressed air to the pneumatic cylinder pump drive system.

Still other objects, features, and advantages of the present invention will become evident to those skilled in the art in light of the following.

DETAILED DESCRIPTION OF THE PREFERRED EMBODIMENT

Figure 1:
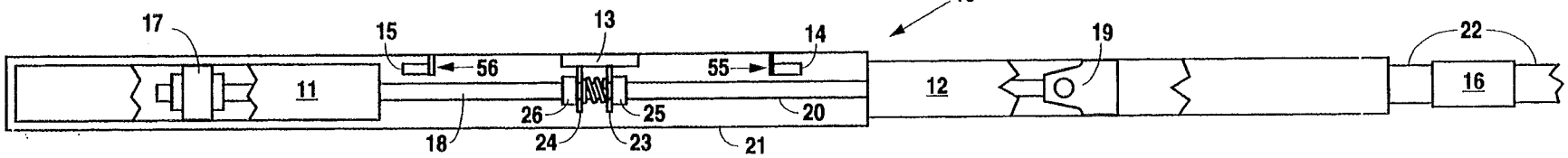
FIG. 1 is a side elevation view in partial cross-section depicting the down hole pump of the present invention positioned within a borehole.

As illustrated in FIG. 1, downhole pump 10 comprises housing 21 which contains pneumatic cylinder 11 and supports pilot valve 13 and trip valves 14 and 15. Pilot valve 13 and trip valves 14 and 15 mount to the inner wall of housing 21 using any suitable means such as brackets. Downhole pump 10 further comprises pump cylinder 12 which includes an inlet (not shown) for fluids from the well and an outlet connected to pipe 22 which delivers the fluid pumped from pump cylinder 12 to an above-ground reservoir (not shown). Pipe 22 comprises any suitable fluid transfer pipe such as steel or plastic pipe and has a length equal to the depth of the well to permit downhole pump 10 to be placed at the bottom of the well. Valve 16 resides within pipe 22 and comprises a one-way check valve to prevent fluids pumped from pump cylinder 12 into pipe 22 from returning to pump cylinder 12.

Pneumatic cylinder 11 includes piston 17 connected to push rod 18 while pump cylinder 12 includes piston 19 connected to push rod 20. Push rods 18 and 20 threadably connect together to couple piston 17 to piston 19 to allow pneumatic cylinder 11 to drive pump cylinder 12. Push rod 18 screws within push rod 20 to provide the connection point between piston 17 and 19, however, the outer surface of push rod 20 includes threads to allow plates 23 and 24 to be mounted thereon. Specifically, plates 23 and 24 connect to nuts 25 and 26 using any suitable means such as welding wherein nuts 25 and 26 threadably mount onto push rod 20 to permit the positioning of plates 23 and 24 about push rod 20.

Figure 2:
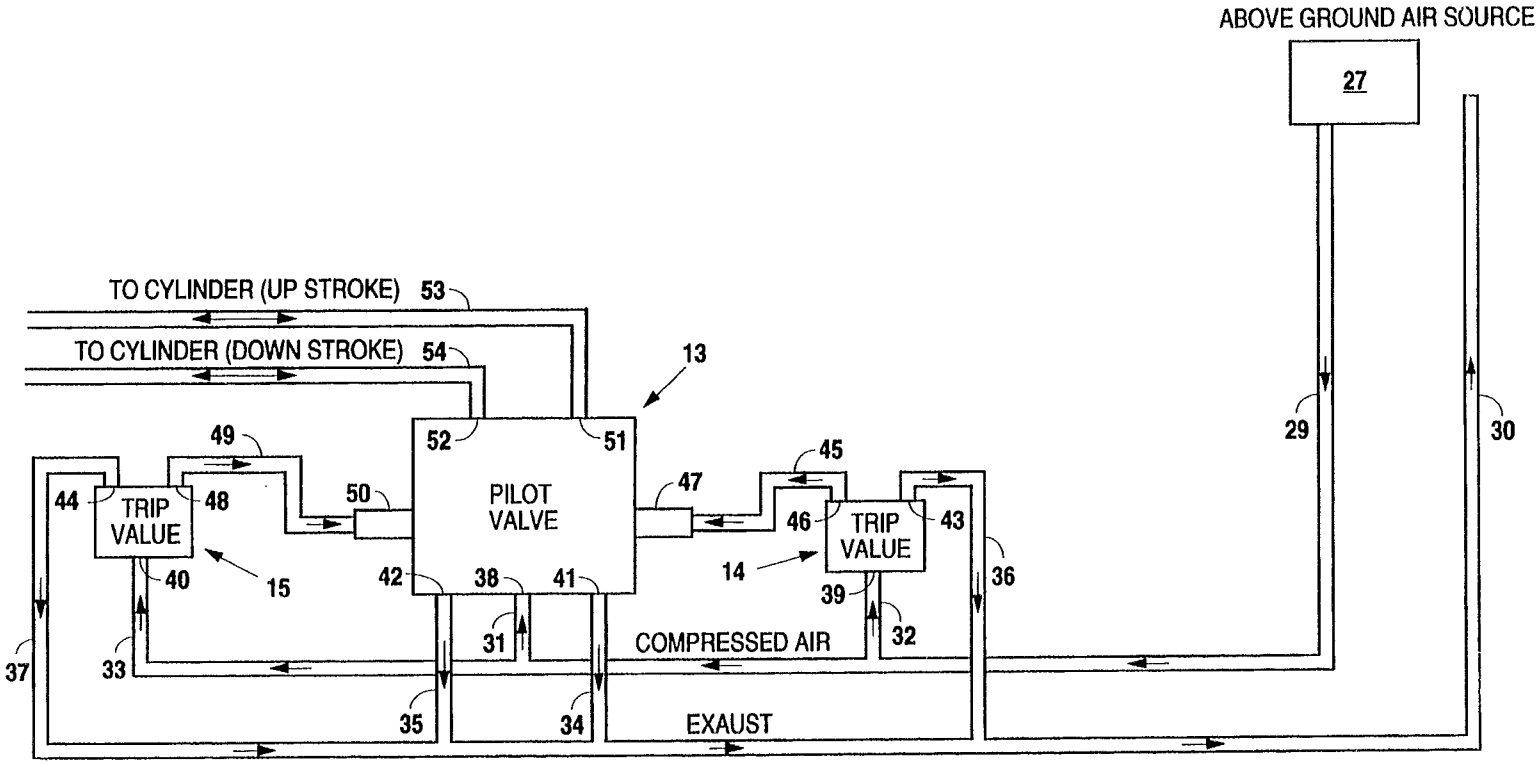
FIG. 2 is a schematic diagram depicting the valve control system for the downhole pump of the present invention.

Referring to FIG. 2, the operation of pilot valve 13 and trip valves 14 and 15 to control the delivery of compressed air to pneumatic cylinder 11 will be described. Compressor 27 resides exterior to the borehole at a position next to a windmill (not shown) which provides power to compressor 27 to allow the compressing of air. Both the windmill and compressor 27 do not require placement in close proximity to the borehole because feed line 29 may be of any length necessary to deliver compressed air from compressor 27 down the borehole to pilot valve 13 and trip valves 14 and 15. Similarly, exhaust line 30 may be of any length required to provide a return line for compressed air delivered into pneumatic cylinder 11.

In this preferred embodiment, pilot valve 13 comprises a model 42AP four-way valve while trip valves 14 and 15 each comprise a model 31P three-way valve. Feed line 29 connects to inlet port 38 of pilot valve 13 via line 31, while inlet port 39 of trip valve 13 and inlet port 40 of trip valve 15 connect to feed line 29 via lines 32 and 33, respectively. Exhaust line 30 connects to exhaust ports 41 and 42 of pilot valve 13 via lines 34 and 35, respectively. Similarly, exhaust port 43 of trip valve 14 connects to exhaust line 30 via line 36, and exhaust port 44 of trip valve 15 connects to exhaust line 30 via line 37. Control port 46 of trip valve 14 connects to actuator port 47 of pilot valve 14 via line 45, while control port 48 of trip valve 15 connects to actuator port 50 of pilot valve 13 via line 49. Actuator ports 47 and 50 connect trip valves 14 and 15 with the valve actuator (not shown) of pilot valve 13 to permit trip valves 14 and 15 to control pilot valve 13. Finally, cylinder port 51 of pilot valve 13 connects to the rear of pneumatic cylinder 11 to provide for the upstroke of piston 17, while cylinder port 52 connects to the top of pneumatic cylinder 11 via line 54 to permit the down stroke of piston 17.

Thus, in operation, trip valves 14 and 15 control pilot valve 13 so that it alternately delivers compressed air from compressor 27 to the top and bottom of pneumatic cylinder 11 to reciprocally drive piston 17. Trips valves 14 and 15 include buttons 55 and 56, respectively, which control the operation of their ports. That is, as piston 17 travels up and down within pneumatic cylinder 11, it drives plates 23 and 24 up and down within housing 21 to actuate trip valves 14 and 15. Illustratively, on an upstroke, piston 17 travels to the top of pneumatic cylinder 11 until plate 23 pushes button 55 whereupon the flow of compressed air to pneumatic cylinder 11 reverses to drive piston 17 towards the bottom of pneumatic cylinder 11. Piston 17 travels towards the bottom of pneumatic cylinder 11 until plate 24 pushes button 56 of trip valve 15 to again reverse the flow of compressed air to pneumatic cylinder 11 to reverse the motion of piston 17.

When plate 24 pushes button 56 of trip valve 15, exhaust port 44 which is normally open, closes and control port 48 opens to deliver compressed air received at inlet port 40 from compressor 27 to actuator port 50 of pilot valve 13. The compressed air delivered into pilot valve 13 at actuator port 50 forces the valve actuator away from actuator port 50 towards actuator port 47. That movement of the valve actuator results in inlet port 38 connecting to cylinder port 51 and exhaust port 42 connecting to cylinder port 52. Consequently, compressor 27 delivers compressed air into cylinder port 51 via inlet port 38 to supply pneumatic cylinder 11 with compressed air below piston 17 to force piston 17 in an upstroke. Furthermore, as piston 17 travels in its upstroke, it forces any compressed air residing above it from line 54 to exhaust line 30 due to the connection of cylinder port 52 to exhaust port 42. Thus, piston 17 travels in an upstroke until plate 23 pushes button 55 on trip valve 14.

With button 55 pressed, inlet port 39 connects to control port 46 to deliver compressed air to pilot valve 13 via actuator port 47, resulting in the valve actuator traveling from actuator port 47 towards actuator port 50. No residual compressed air resides between trip valve 15 and actuator port 50 because trip valve 15 includes exhaust port 44 which is normally open. More particularly, while plate 24 presses button 56, trip valve 15 delivers compressed air to pilot valve 13. However, as soon as piston 17 moves plate 24 from button 56, a spring (not shown) within trip valve 15 opens exhaust port 44 to connect it to control port 48, thereby removing compressed air from actuator port 50. Consequently, when trip valve 14 delivers compressed air into pilot valve 13, no resistance from trip valve 15 will be experienced because any compressed air escapes line 49 via its normally open connection to exhaust line 30. Trip valve 14 operates identically during the delivery of compressed air into pilot valve 13 by trip valve 15 to prevent air resistance from hindering the travel of the valve actuator within pilot valve 13.

As trip valve 14 delivers compressed air into pilot valve 13 via actuator port 47, the valve actuator connects inlet port 38 to cylinder port 52 and exhaust port 41 to cylinder port 51. Consequently, line 54 delivers compressed air above piston 17 while line 53 exhausts compressed air from below piston 17. Accordingly, piston 17 travels toward the bottom of pneumatic cylinder 11 until plate 24 again trips button 56. Thus, as trip valves 14 and 15 alternately control pilot valve 13 to deliver compressed air to pneumatic cylinder 11, piston 17 reciprocates within pneumatic cylinder 11 to drive piston 19. That is, as piston 17 reciprocates within pneumatic cylinder 11, it drives piston 19 of pump cylinder 12 reciprocally within pump cylinder 12 through its connection to push rod 20 via push rod 18.

On the downstroke of piston 19, the pump chamber of pump cylinder 12 fills with water, whereupon, on the upstroke of piston 19, piston 19 forces that water into pipe 22 where it displaces water currently residing within pipe 22. The displaced water exits pipe 22 into the above-ground reservoir. Valve 16 permits piston 19 to force water within pipe 22, however, once the water enters pipe 22, valve 16 prevents that water from returning into the pump chamber of pump cylinder 12 on the downstroke of piston 19. Thus, as piston 17 reciprocally operates within pneumatic cylinder 11 under the control of pilot valve 13 and trip valves 14 and 15, piston 19 also reciprocates to continually pump water from the well into the above-ground reservoir.

Although the present invention has been described in terms of the foregoing embodiment, such description has been for exemplary purposes only and, as will be apparent to one of ordinary skill in the art, many alternatives, equivalents, and variations of varying degrees will fall within the scope of the present invention. That scope, accordingly, is not to be limited in any respect by the foregoing description, rather, it is defined only by the claims which follow.

I claim:

1. A downhole pump, comprising:

a pump cylinder configured to fit within a well, said pump cylinder communicating with an above-ground reservoir via a pipe;

a pneumatic cylinder configured to fit within the well, said pneumatic cylinder located underneath and remote from said pump cylinder, and said pneumatic cylinder coupled to said pump cylinder wherein a source of compressed gas communicates with said pneumatic cylinder to drive said pneumatic cylinder which, in turn, drives said pump cylinder to pump fluids from the well to the reservoir through said pipe; and valve means interposed to said source of compressed gas and said pneumatic cylinder to control the delivery of compressed gas from said source of compressed gas to said pneumatic cylinder.

2. The downhole pump according to claim 1 wherein said valve means alternately delivers compressed gas to the opposite ends of said pneumatic cylinder to reciprocally drive a piston of said pneumatic cylinder.

3. The downhole pump according to claim 2 wherein said piston of said pneumatic cylinder is coupled to a piston of said pump cylinder through a push rod to reciprocally drive said piston of said pump cylinder.

4. The downhole pump according to claim 3 wherein said valve means comprises:

a pilot valve communicating at an inlet port with said source of compressed gas, the atmosphere at a first and second exhaust ports, a first end of said pneumatic cylinder at a first cylinder port, and a second end of said pneumatic cylinder at a second cylinder port;

a first trip valve communicating at an inlet port with said source of compressed gas, the atmosphere at an exhaust port, and a first actuator port of said pilot valve at a control port wherein when activated said first trip valve delivers compressed gas to said first actuator port of said pilot valve to activate said pilot valve to deliver compressed gas to the first end of said pneumatic cylinder via its inlet port and first cylinder port and exhaust compressed gas from the second end of said pneumatic cylinder via its second cylinder port and second exhaust port; and a second trip valve communicating at an inlet port with said source of compressed gas, the atmosphere at an exhaust port, and a second actuator port of said pilot valve at a control port wherein when activated said second trip valve delivers compressed gas to said second actuator port of said pilot valve to activate said pilot valve to deliver compressed gas to the second end of said pneumatic cylinder via its inlet port and second cylinder port and exhaust compressed gas from the first end of said pneumatic cylinder via its first cylinder port and first exhaust port.

5. The downhole pump according to claim 4 wherein said second trip valve exhausts compressed gas from said second actuator port of said pilot valve via its control port and exhaust port when said first trip valve is activated.

6. The downhole pump according to claim 4 wherein said first trip valve exhausts compressed gas from said first actuator port of said pilot valve via its control port and exhaust port when said second trip valve is activated.

7. The downhole pump according to claim 1 further comprising a one-way valve connected between the outlet from said pump cylinder and the exit from said pipe to prevent fluid pumped from said pump cylinder into said pipe from re-entering said pump cylinder.

* * * * *